US005141043A

United States Patent [19]

Kraeutler

[11] Patent Number: 5,141,043

[45] Date of Patent: Aug. 25, 1992

[54] LIFTING CURTAIN DOOR

[75] Inventor: Bernard Kraeutler, Dunieres, France

[73] Assignee: Nergeco SA, Dunieres, France

[21] Appl. No.: 745,984

[22] Filed: Aug. 7, 1991

Related U.S. Application Data

[63] Continuation of Ser. No. 524,894, May 18, 1990, abandoned.

[30] Foreign Application Priority Data

May 19, 1989 [FR] France ..... 89 06591
Jan. 2, 1990 [FR] France ..... 90 00001

[51] Int. Cl.[5] ..... A47G 5/00

[52] U.S. Cl. ..... 160/264; 160/271; 160/267.1

[58] Field of Search ..... 160/267.1, 272, 273.1, 160/84.1, 264, 271

[56] References Cited

U.S. PATENT DOCUMENTS

| | | | |
|---|---|---|---|
| 972,422 | 10/1910 | Whitmore | 160/267.1 X |
| 1,284,123 | 11/1918 | Masumian | 160/267.1 X |
| 1,694,314 | 12/1928 | Dixson | 160/273.1 |
| 1,779,646 | 10/1930 | Traut | 160/273.1 X |
| 1,786,054 | 12/1930 | Dixson | 160/273.1 |
| 2,094,932 | 10/1937 | Swan | 160/271 X |
| 3,292,685 | 12/1966 | Clark | 160/264 X |
| 4,478,268 | 10/1984 | Palmer | 160/272 X |
| 4,690,195 | 9/1987 | Taylor | 160/271 X |
| 4,880,045 | 11/1989 | Stahler | 160/84.1 |
| 5,025,847 | 6/1991 | Mueller | 160/265 X |
| 5,056,579 | 10/1991 | Krafutler | 160/264 X |

*Primary Examiner*—Blair M. Johnson
*Attorney, Agent, or Firm*—Sughrue, Mion, Zinn Macpeak & Seas

[57] ABSTRACT

A lifting curtain door comprising a frame constituted by two vertical side uprights interconnected at their top ends by a cross member, the side uprights each constituting or including a slideway, each slideway having a guide wall on either side of the plane of the curtain, which curtain may be gathered together at the top of the door by being rolled up or folded, the curtain being reinforced by horizontal bars whose ends slide in the slideways. At least one of the bars has sufficient flexibility at least one portion of its length to enable it to escape from at least one of the slideways in the event of an abnormal transverse force being applied to the bar, without the bar being deformed permanently which could impede subsequent operation of the curtain.

10 Claims, 3 Drawing Sheets

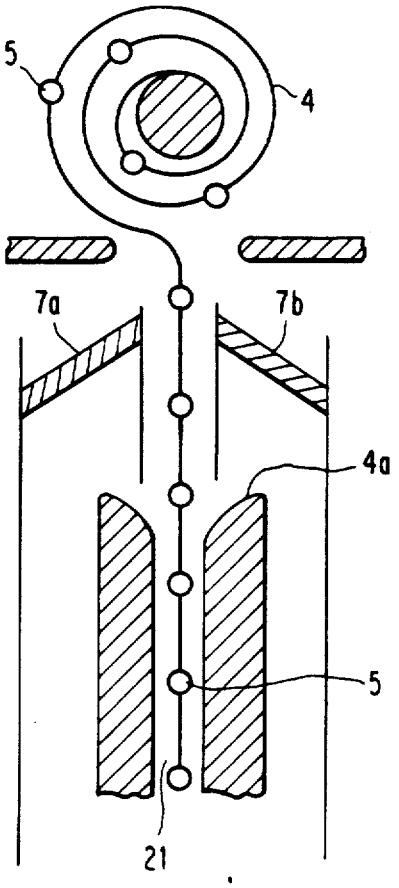
FIG. 4
FIG. 6
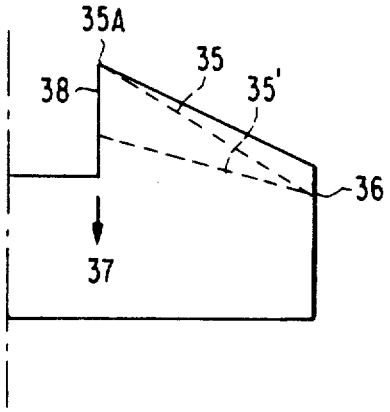
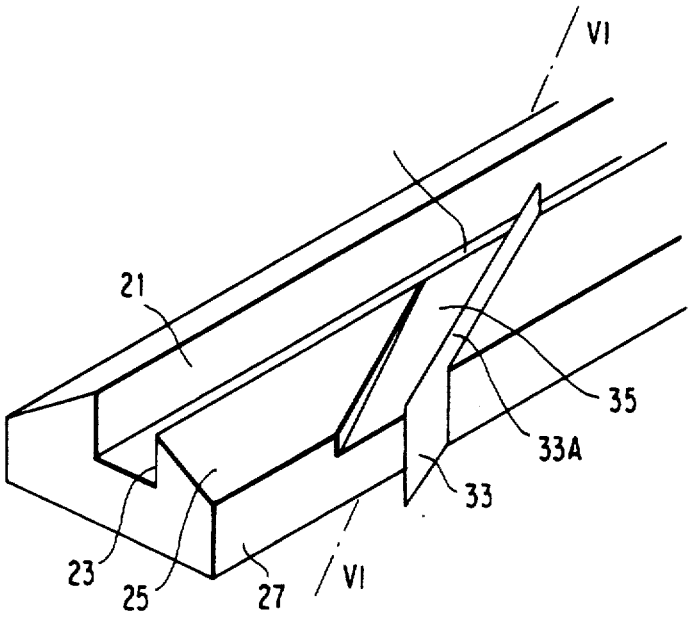
FIG. 5

LIFTING CURTAIN DOOR

This is a continuation of application Ser. No. 07/524,894 filed May 18, 1990 now abandoned.

The present invention relates to doors for industrial buildings and premises, hangars and warehouses, in which the door is constituted by a flexible, semi-rigid, or rigid, curtain which is foldable or rollable and which opens a doorway by being raised, and which closes it by being lowered, with the curtain being stored at the top of the door when raised, either by being rolled up or by being folded.

BACKGROUND OF THE INVENTION

Some doors of this type are exposed to the action of the wind. Various means are known for preventing major deformation which could damage the door or jam it. The vertical edges of the curtain may have a portion of greater thickness or skids fixed thereon for sliding in a channel (like sails on a boat). Vertically spaced-apart horizontal reinforcing bars are also used with their ends sliding in slideways. The invention relates, in particular, to a lifting curtain door comprising a frame constituted by two vertical side uprights interconnected at the top by a cross-member, each of the said side uprights comprising or including a slideway with each slideway having a guide wall on either side of the plane of the curtain with the curtain being gathered together at the top by rolling up or by folding, the curtain being reinforced by horizontal bars whose ends slide in the said slideways.

These various systems suffer from the drawback that during various kinds of traffic accident, when a vehicle strikes the door before the door is fully opened, the door is damaged. Indeed the door is often jammed and it is necessary to dismount the door. Traffic is interrupted and repairs may be expensive, the curtain may be torn; a twisted bar may need extracting; etc.

The Applicant has already proposed a reinforcing bar device in which the ends sliding in the slideways include a section of weakness. As a result, when there is a shock against the bar, it breaks at the end and the door can still be operated. There is merely the end of one of the bars that is no longer guided and this is easily repaired by replacing the broken part.

Although the above system is advantageous in many applications, it is not suitable for all applications, and a certain amount of time must nevertheless be allowed for performing repairs.

The object of the present invention is to avoid the door being damaged when a vehicle strikes against the curtain before it is fully opened, or when excessive wind force is applied thereto, so that under the effect of such a shock, the door, or at least one of the door components, is subjected to nonpermanent deformation, thereby enabling the door to return to its proper position merely by being operated and without any other action being taken.

SUMMARY OF THE INVENTION

The invention thus provides a lifting curtain door including a lifting curtain capable of being gathered together at the top of the door by being rolled up or folded, the curtain being reinforced by horizontal bars or equivalent means such as panels whose ends slide in two vertical slideways having guide walls on either side of the plane of the curtain, wherein at least one of the bars has sufficient flexibility at at least one portion of its length to enable it to escape from at least one of the slideways in the event of an abnormal transverse force being applied to the bar, without the bar being deformed permanently which could impede subsequent operation of the curtain.

In one embodiment, at least one bar is flexible overall.

In a variant, at least one bar is flexible in the middle.

In another embodiment, at least one bar has deformable ends.

The above dispositions thus enable the door to withstand a shock or abnormal thrust without being damaged. However, it is still necessary, after a bar has escaped from its slideways, to put the bar back into place. The invention also provides means for facilitating returning a bar into slideways from which it has escaped. Advantageously, the invention provides for a bar to be returned into its slideways automatically without requiring special action to be taken, either while the door is being raised, or else while the door is being lowered again after it has been opened.

To this end, in one embodiment of the invention the outside walls of the slideways or of walls fixed to the slideways define vertical planes that slope relative to the plane of the door, with the two walls of each slideway extending towards each other towards the center of the door.

Advantageously, the slideway is limited vertically at a level situated beneath the bottommost bar when the curtain is raised, and has an upwardly flared opening beneath said bar when in its raised position such that the bottommost bar and subsequently all the other bars engage in the slideway while the curtain is being lowered.

In an advantageous form of the invention, the wall of the slideway or the wall of the upright including the slideway includes at least one moving wall element capable of deforming elastically so as to form a path enabling an end of the bar to pass from the outside of the slideway to the inside, but not in the opposite direction.

In another particularly advantageous embodiment, in which neither the uprights nor the slideways include any moving parts, at least one of the outside walls of the uprights including the slideways is provided with a guide projecting from said wall and directed generally upwards towards the opening of the slideway, said guide extending over at least a portion of the width of the said wall to the edge of the slideway opening so as to return any bar end that may have escaped to the slideway as it is pulled upwards, with the bar being deformed so as to be shortened by bending or by contraction (e.g. by telescopic shortening).

BRIEF DESCRIPTION OF THE DRAWINGS

Embodiments of the invention are described by way of example with reference to the accompanying drawings, in which:

FIG. 4 is a section view on a vertical plane through a portion of the door shown in FIG. 1;

FIGS. 5 and 6 are a perspective view and a section through one embodiment of a slideway for a door of the invention;

DETAILED DESCRITPION

Figure 1:
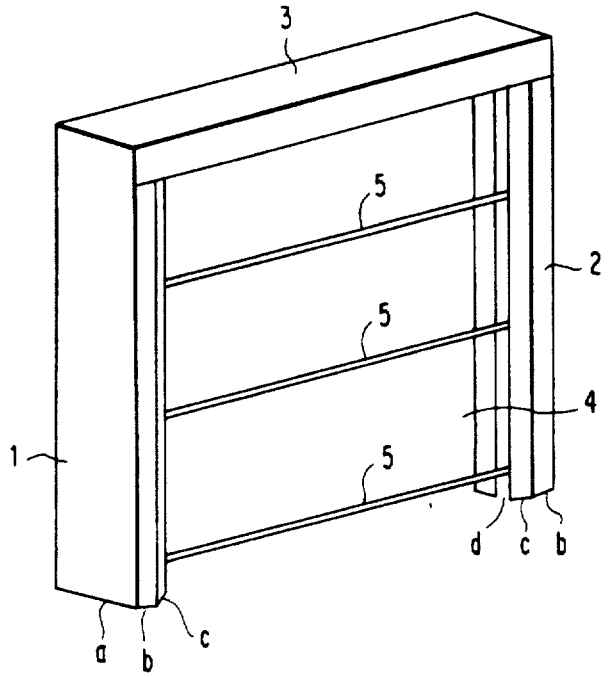
FIG. 1 is a perspective view of a door of the invention.

FIG. 1 is a perspective view of one embodiment of a door frame for a curtain type door of the invention. The frame comprises two vertical side uprights 1 and 2 interconnected at their top ends by a cross bar 3 constituting a lintel.

The cross section of each upright is in the form of a pentagon which is open at one of its vertices, having a base a, two sides b extending perpendicularly to the base, and two sides c extending towards each other and leaving a gap d between their adjacent ends, thereby forming the opening to a slideway 21 in each of the uprights and suitable for receiving a corresponding edge of the curtain 4 together with the ends of curtain reinforcing bars 5. Corresponding sides may be equal in size or otherwise. In order to make the drawings easier to understand, the curtain is assumed to be made of transparent material (which is possible in practice and is indeed done in some cases).

Figure 2:
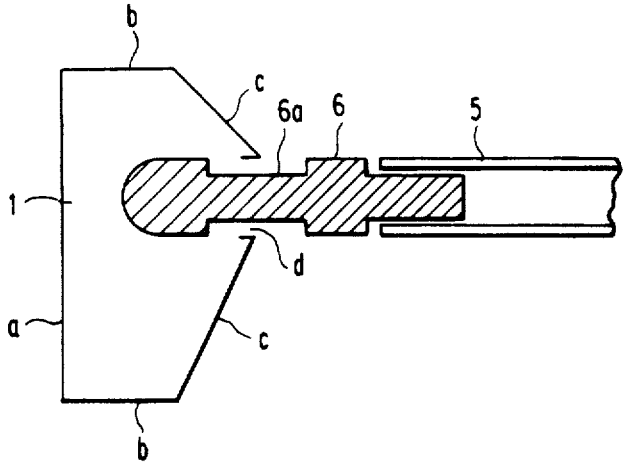
FIG. 2 is a section view on a horizontal plane through one of the uprights of the door shown in FIG. 1.

FIG. 2 is a horizontal section view through an upright and through one end of a curtain reinforcing bar, showing how the bar is disposed in the slideway.

According to the invention, the reinforcing bars are made sufficiently flexible that when subjected to thrust they are capable of leaving the guide groove prior to being subjected to permanent deformation or to subjecting the guide groove itself to permanent deformation. This may be obtained by the bar assembly being flexible. Flexibility may be provided by means of a glass fiber reinforced plastic tube capable of absorbing considerable non-permanent deformation so that one or both of its ends may leave the groove without permanent deformation or breakage. Flexibility may be limited to a portion of the bar, e.g. its middle, or to its ends. The middle of the bar may be constituted by a more flexible portion, e.g. a resilient sleeve or a coil spring, thereby enabling the bar to fold. The bar 5 may also be provided with endpieces 6 made of flexible material, e.g. rubber, which are engaged in the two ends of the bar which may then be a tube made of metal or any other material. The endpiece may be semirigid so as to withstand normal thrusts (wind) or thrusts slightly higher than normal, and may include a zone 6a of narrowing enabling it to bend in the event of a sudden thrust or a thrust which is very strong.

Figure 3:
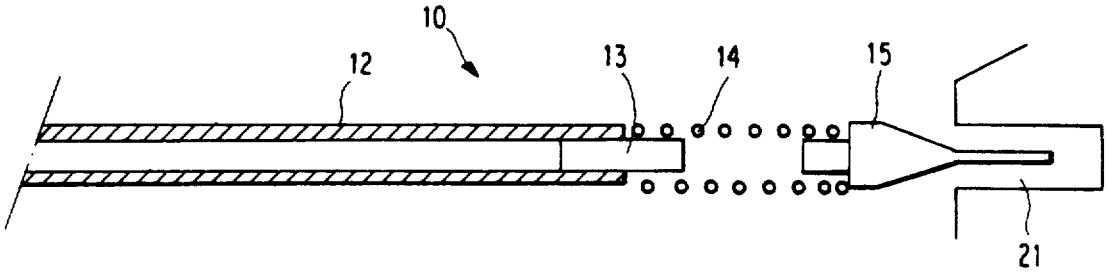
FIG. 3 shows a variant of the embodiment of FIG. 2.
Figure 7:
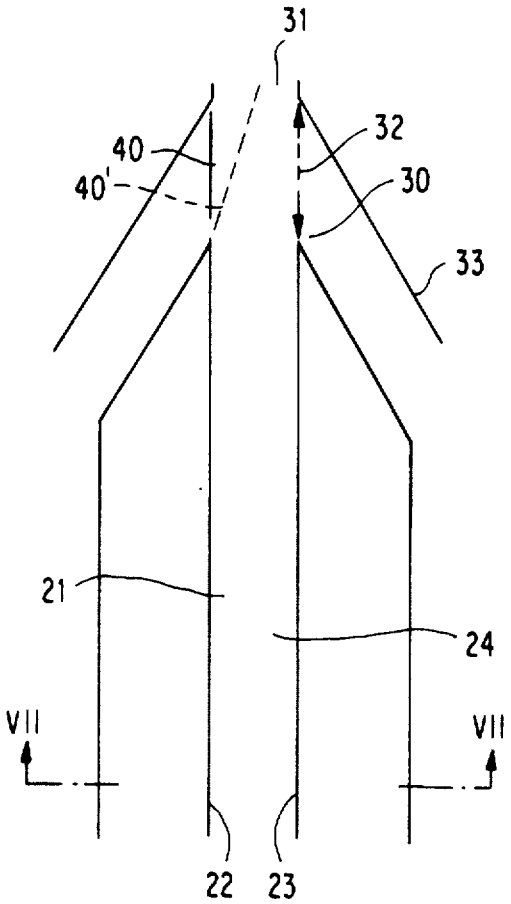
FIGS. 7 and 8 are analogous to FIGS. 5 and 6 and relate to a variant door.
Figure 8:
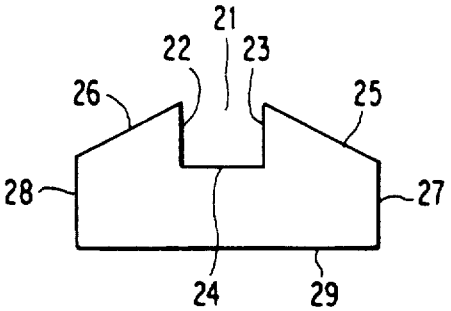

FIG. 3 is a section through another embodiment of the end of a bar. The horizontal reinforcing bar 10 is constituted by a tube 12 with a mandrel 13 received in the end thereof, and with a spring 14 engaged on the mandrel. The dimensions of the mandrel and of the spring are selected so that these parts are capable of holding together without additional means merely by being pushed together as shown. It is preferable, although clearly not essential, to avoid any need for riveting, welding, etc. . . . operations. In a variant, the spring could be engaged inside the tube 12. Similarly, an endpiece 15 is fixed to the other end of the spring. Because of material wear and because of the need to reduce noise in operation, it is preferable to ensure that the spring does not rub directly against the slideway 21. It will readily be understood that if sufficiently large force is applied to the bar, then its end, i.e. the endpiece 15, may leave the slideway because the end of the bar deforms, i.e. because the spring 14 folds without being damaged. Conversely, after it has escaped from the slideway, the end of the bar is easily returned into the slideway, e.g. by applying adequate thrust or by manually folding over the endpiece 15 to cause it to penetrate back into the slideway.

Under such conditions, in the event of excessive force being applied to a door, the bars escape from the slideways because of the flexibility of the bars 5, 10.

It is advantageous to avoid any need for manual intervention to put the system back into place. The directions in which the faces c of the uprights constituting the slideways extend facilitate reinserting the bars in the slideways while the curtain is being raised under the effect of upwards traction exerted on the bars by the curtain. It is also advantageous to provide complementary dispositions for forcing the ends of the bars to go back into the slideways. To this end, in an embodiment of the invention shown in FIG. 4 (which is a section view on a vertical plane perpendicular to the curtain 4 and taken in the middle thereof), the slideways 21 may come to an end a little below the volume in which the curtain is stored, e.g. by being rolled up as shown in section in the figure. The slideway ends may have upwardly flared ends 21a so that when the curtain is lowered again, the ends of the bar naturally engage in the slideways 21.

In order to facilitate returning the bar ends to their proper places while the curtain is being raised, reinsertion ramps or recentering surfaces 7a are provided above the flare of the slideway and beneath the curtain storage zone such that when the curtain is raised, the ends of the bars are returned to the axis of the curtain-storage zone.

The space between the flare 21a and the reinsertion ramp 7 forms a reinsertion window. A plurality of them may be provided up the height of the curtain.

The apparatus described above with reference to FIG. 4 has a gap in the slideway at each reinsertion ramp. While the curtain is being lowered and going past a gap, the wind may move it off axis so that it continues to go down outside the slideways. Such apparatus is therefore not suitable for being placed in locations that may be exposed to the wind or to large drafts. FIGS. 5 to 8 show variant embodiments of the invention that avoid this limitation.

These variants all include a slideway 21 as described above. The slideway 21 is essentially defined by two parallel plane walls 22 and 23 on either side of the curtain plane, and delimiting an intersticial space in which the ends of the horizontal reinforcing bars of the curtain door move, said ends being guided by the walls 22 and 23. The bottom of the slideway groove may be closed by a wall 24, thereby improving stiffness and protecting the inside of the slideway from dust and other foreign bodies. According to a characteristic of the invention, the slideways are coated on the outsides of their sloping faces 25 and 26 (protective walls), thereby facilitating reinsertion of escaped bar ends back into the slideways. A slideway generally includes additional side walls 27 and 28 and a bottom wall 29 so as to constitute a rigid assembly.

Figure 9:
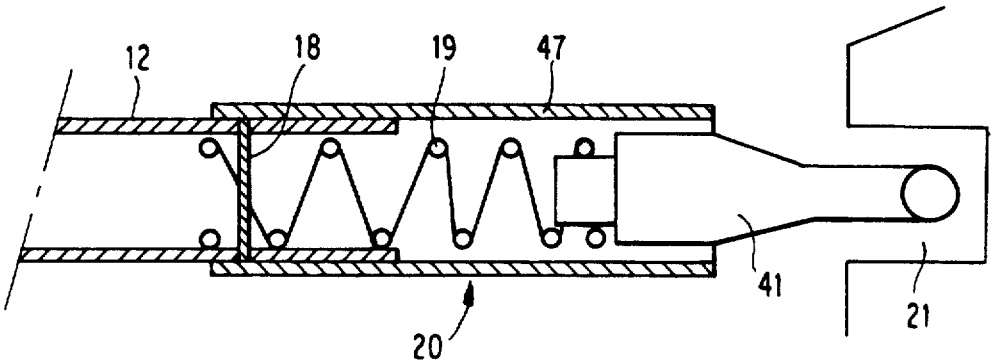
FIG. 9 is a section through the end of a reinforcing bar for a flexible curtain and specially designed to facilitate reinsertion of the curtain into its slideways after it has been removed therefrom by an abnormal force.

In the embodiment shown in part and in diagrammatic perspective in FIG. 5, the slideway 21 does not include any gaps. However a reinsertion ramp 35 is provided, preferably near the top of the door. When a bar has escaped from the slideway 21, then the end of the bar will rub against the surface 25 or 27 of the section member surrounding the slideway. On reaching the ramp 35, the end of the bar is engaged thereon by traction due to the curtain being raised, and also by the effect of the inclined guide 33. The end of the bar moves up the ramp 35 which causes the bar to shorten. This may be achieved by the bar bending, or if it is made as shown in FIGS. 3 or 9, by a spring deforming or contracting. The end of the bar is guided to the end 35A of the ramp, after which it expands so as to return into the slideway 21. Since the slideway has no gaps, the bars are prevented from escaping from the slideway while the curtain is being lowered even if the curtain is subjected to strong wind.

In order to facilitate shortening the bar, so as to allow it to slide easily along the guide 33A, and so as to facilitate reinsertion into the slideway, the ends of the bars may be telescopic, as shown in FIG. 9 for the bar 20.

A sleeve 47 is mounted on the end of the tube 12, either by being force-fitted thereon or else by means of a pin 18 which simultaneously serves to hold the inside end of the spring 19 which urges a piston 41 outwards, the piston having a function equivalent to that of the endpiece 15 of the bar shown in FIG. 3. Unlike the previous example, the end of the bar 10 need not be flexible. In order to enable the bar to escape from its slideways under the effect of an abnormal force, the bar must be flexible overall or else it must include a zone, e.g. a central zone, which is particularly flexible. However, once such a bar has escaped from the slideway, it can clearly be seen that it can be returned thereto by pushing the piston 24 into the sleeve 17, e.g. by hand or else while the curtain is being raised by virtue of a suitable guide ramp onto which the piston is directed during curtain raising. While the bar is being raised, the piston 41 is thrust by the ramp into the tube 12 and is guided to the edge of the slideway. At this moment, the spring 19 is free to expand and the piston is reengaged in the slideway. It is then no longer capable of escaping therefrom merely by being lowered again.

In FIG. 5, the guide ramp is shown as being a small hollow relative to the sloping surface 25. This is not essential. The ramp may be constituted solely by the projecting rim 33A of the reinsertion guide. In this case, the guide may be fixed or displaceable or removable. In this case, the surface 25 may also be parallel to the bottom 29 of the slideway.

In a variant embodiment, in order to facilitate reinsertion of bars that are simpler in structure, the ramp 35 may be displaceable so as to temporarily open a window in the wall 23 of the slideway. For example, the ramp may be hinged about the bottom edge 36, and a section 38 of the wall 23 may be displaceable in the direction of arrow 37. FIG. 6 is a section on line VI—VI of FIG. 5, and shows the ramp in its normal position at reference 35, and in its pushed down position at reference 35'. The extent to which the slideway can be pushed down may be defined as a function of the nature of the bars and of the ease with which they bend or of their ability to shorten. In practice, this local mobility may be obtained by forming a cut-out in the wall of the upright.

In another embodiment of the invention, in order to prevent bars from escaping from the slideway while the curtain is being lowered, the reinsertion window 32 (righthand portion of FIG. 7) may be closed by a deformable or hinged shutter 40 (lefthand side of FIG. 7) which is urged when in its rest position to remain in a plane parallel to the curtain but which is capable of occupying a position 40' by deforming into the slideway under thrust from the end of a bar as pulled by the curtain being raised. Once the curtain has been gathered together at the top of the door, the shutter 40 returns to its position lying flush with the wall 22 of the slideway and the curtain may be lowered again without running any risk of it escaping from the slideway.

The shutter 40 may be a flexible metal blade fixed at one end by means of rivets. Alternatively it may be formed merely by forming a cut-out in the wall of the slideway, depending on the resilient nature of the material from which the slideway is made.

All of the bars may be made in the same way. However it is also possible to provide only one bar in accordance with the invention, e.g. the bar which is in greatest danger, or the bottom bar.

I claim:

1. An industrial lifting curtain door, comprising:

a frame comprising at least two vertical side uprights interconnected at top ends by a cross member, each of said side uprights further comprising a slideway, each of said slideways having a guide wall disposed on either side of the plane of a curtain, having a predetermined polygonal cross section and each of said slideways having an opening permitting movement of a portion of the curtain in said slideway; and said curtain can be accumulated above the door, said curtain further comprising a plurality of horizontal bars reinforcing said curtain and having ends sliding in said openings of said slideways, wherein at least one of the bars has sufficient flexibility at at least one portion of its length to enable it to escape from at least one of the slideways in the event of an abnormal transverse force being applied to the bar, without the bar or said side uprights being deformed permanently so as to impede subsequent operation of the curtain.

2. A door according to claim 1, wherein at least one of said bars is flexible overall.

3. A door according to claim 1, wherein at least one of said bars is flexible in the middle.

4. A door according to claim 1, wherein at least one of said bars has flexible ends.

5. A door according to claim 4, wherein a selected one of said bars further comprises means for extending said ends of said selected bar, said means for extending including at least one coil spring.

6. A door according to claim 5, wherein said selected bar comprises a tube, and wherein said means for extending comprises said spring having one end disposed within said tube and having another end extending said end of said selected bar beyond an end of the tube to provide flexibility to said selected bar.

7. A door according to claim 6, wherein said means for extending further comprises a slider shoe fixed to the end of the spring for sliding in the slideway.

8. A door according to claim 1, wherein at least one of said bars further comprises at least one tubular end, a piston, and a spring disposed in said tubular end for urging said piston out from the at least one bar, said piston sliding in the tubular end of the at least one bar and extending into the slideway opposing said piston.

9. A door according to claim 1, wherein each of said slideways further comprises a plurality of outside walls and wherein at least one of the outside walls of the slideways and walls fixed to the slideways define vertical planes having predetermined slopes relative to the plane of the door so as to provide at least two walls of each of said slideways extending towards each other and towards the center of the door.

10. A door according to claim 1, wherein each of said slideways is limited vertically at a level situated beneath the lowest of said bars when the curtain is raised, and each of said side uprights further comprises a flared opening which is flared upwards so that when the curtain is lowered from its raised position, the ends of the bars engage said flared opening.

* * * * *